US009065185B2

(12) United States Patent
Magnezi et al.

(10) Patent No.: US 9,065,185 B2
(45) Date of Patent: Jun. 23, 2015

(54) DUAL-DIRECTION CONNECTOR AND METHOD FOR CABLE SYSTEM

(75) Inventors: Gavriel Magnezi, Givat Shmuel (IL); Olga Degtyarev, Lod (IL); Yasis Shohet, Ramat-Gan (IL); Yehezkel Albag, Nordia (IL)

(73) Assignee: Xtend Networks Ltd. GA (US)

( * ) Notice: Subject to any disclaimer, the term of this patent is extended or adjusted under 35 U.S.C. 154(b) by 0 days.

(21) Appl. No.: 12/650,796

(22) Filed: Dec. 31, 2009

(65) Prior Publication Data

US 2010/0173523 A1 Jul. 8, 2010

Related U.S. Application Data

(60) Provisional application No. 61/142,234, filed on Jan. 2, 2009.

(51) Int. Cl.
*H01R 24/50* (2011.01)
*H01R 9/05* (2006.01)

(52) U.S. Cl.
CPC ..... *H01R 9/0506* (2013.01)

(58) Field of Classification Search
USPC ..... 439/63, 581, 579, 224; 307/147
IPC ..... H01R 2130/00,24/50, 24/52, 9/0515, H01R 13/658, 13/65807
See application file for complete search history.

(56) References Cited

U.S. PATENT DOCUMENTS

| | | | | |
|---|---|---|---|---|
| 3,881,160 | A | 4/1975 | Ross | |
| 4,655,534 | A | 4/1987 | Stursa | |
| 5,058,198 | A | 10/1991 | Rocci et al. | |
| 5,194,947 | A | 3/1993 | Lowcock et al. | |
| 5,597,323 | A | 1/1997 | Resnick et al. | |
| 5,677,578 | A | 10/1997 | Tang | |
| 5,718,592 | A * | 2/1998 | Hosler et al. | 439/63 |
| 5,814,905 | A | 9/1998 | Tang | |
| 6,250,960 | B1 | 6/2001 | Youtsey | |
| 6,361,348 | B1 | 3/2002 | Hall et al. | |
| 6,390,829 | B1 * | 5/2002 | Rademacher | 439/74 |
| 6,450,836 | B1 | 9/2002 | Youtsey | |
| D563,900 | S | 3/2008 | Tang | |
| 7,581,958 | B2 * | 9/2009 | Swanson et al. | 439/63 |
| 7,625,247 | B1 * | 12/2009 | Mahoney et al. | 439/700 |
| 2005/0286836 | A1 | 12/2005 | Feinweber et al. | |
| 2008/0044251 | A1 | 2/2008 | Wakamatsu et al. | |

OTHER PUBLICATIONS

International Search Report of Application No. PCT/IL2009/001229 mailed on May 14, 2010.

* cited by examiner

*Primary Examiner* — Hien Vu
(74) *Attorney, Agent, or Firm* — Pearl Cohen Zedek Latzer Baratz LLP

(57) ABSTRACT

A connector for connecting a coaxial cable to a components box is disclosed, the connector is adapted to receive a central conductor of the coaxial cable and to firmly connect it to a central pin in the connector using a seizing force of a springy element, without needing to use a fastening screw or the like and without needing to open the component box. The connector of the invention is further adapted to allow releasing the central conductor from the central pin without needing to unfasten a screw or opening the component box. The connector is further adapted to facilitate the connection of the coaxial cable to the connector in another orientation similarly, without needing to use a fastening screw or the like and without needing to open the component box.

6 Claims, 5 Drawing Sheets

DUAL-DIRECTION CONNECTOR AND METHOD FOR CABLE SYSTEM

CROSS REFERENCE TO RELATED APPLICATIONS

This application claims the benefit of U.S. Provisional Application Ser. No. 61/142,234, filed Jan. 2, 2009, which is hereby incorporated by reference in its entirety.

BACKGROUND OF THE INVENTION

In cable television systems (CATV) audio, video and data, typically at frequencies ranging at 0.1-3 GHz, may be distributed through a coaxial network. The same coaxial network may also carry 8-15 A alternating current, typically at 50 or 60 Hz, to power, for example, the trunk line amplifiers and other active units. Passive network elements such as multi-tap splitters and other line units may be connected on the main coaxial line of the network. Passive units, also referred to throughout this description as passive boxes, are expected to deliver small portion of signal energy to the subscriber through tap ports while passing through most of the RF signal. Passive boxes are typically equipped with at least one main line input, one main line output and a plurality of tap ports.

Cable TV passive units typically employ external housing, or box, which may typically employ two or more connectors having connection mechanism called "seizer screw" to connect the coaxial center cable conductor to components inside the passive/active unit. Seizer screw arrangement typically enables technicians to accommodate connection of coaxial cable entering a CATV passive/active box in one orientation of the box (also called 'pedestal connection') or entering the CATV passive/active box in a second orientation, at substantially 90 degrees with respect to the pedestal connection (also called 'aerial connection'). When connecting a coaxial cable to the box or when changing the existing connection so that the coaxial cable enters the box in the other possible orientation, the technician may have to change the orientation of the connector inside the box. This is typically done by removing the face plate of the box and a card with electronic components, un-tightening the seizer screw fixing the center cable conductor, pulling the coaxial cable outside the connector, and turning it to accept the new required orientation, pedestal or aerial direction, as needed. Following the change of orientation of the connector, the coaxial cable may be inserted into the receiving cavity of the connector and the seizer screw may be tightened using a screwdriver in order to ensure good contact to the center conductor. The screwdriver may be inserted to meet the seizer screw via the opening in the box of the not-in-used direction (or orientation), which typically requires both exact operation by the technician and enough space around the box for inserting the screwdriver, which may not be available in many cases. The seizer screw tightening arrangement provides relatively poor high frequency and high current performance, and in practice is difficult to handle, especially in cases where there is only limited access for a screwdriver to reach the seizer screw head and limited lighting conditions.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1A:
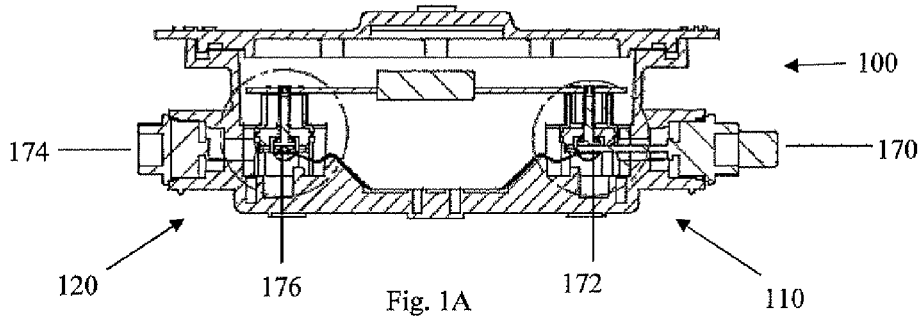
FIGS. 1A and 1B are schematic cross-sectional side view and a top view, respectively, of a components box with a cable connector according to embodiments of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF EMBODIMENTS OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Figure 1B:
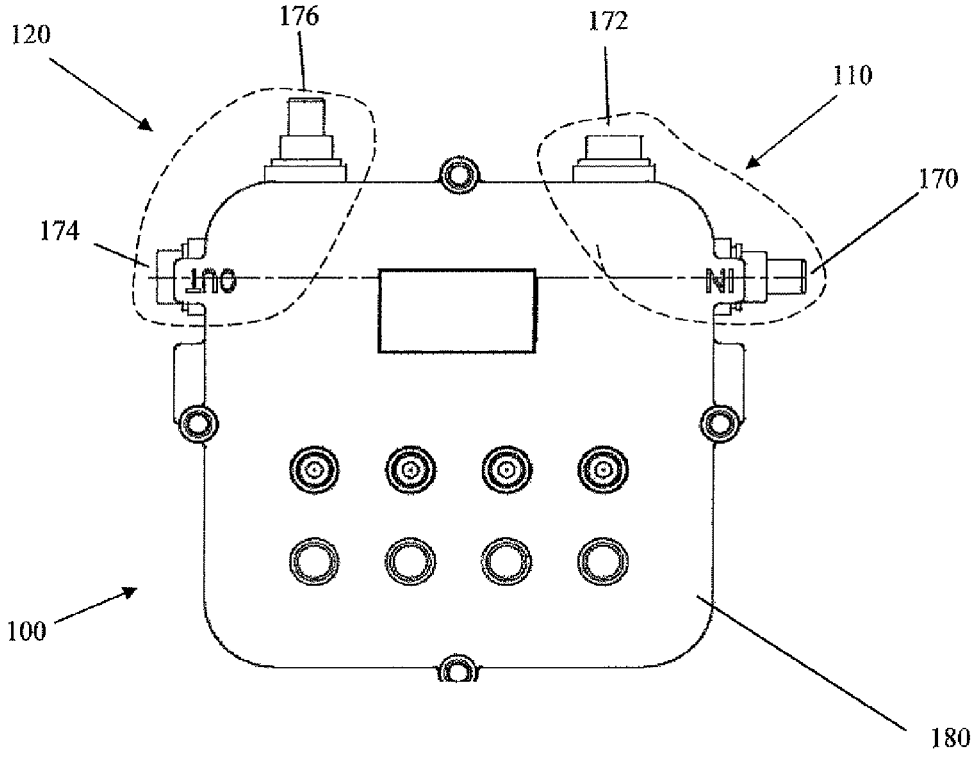

Reference is now made to FIGS. 1A and 1B which are schematic cross-sectional front view and a top view, respectively, of a components box 100 with a cable connector according to embodiments of the present invention. Components box 100 may be a multi tap splitter or the like, with dual orientation connector arrangements 110, 120 according to some embodiments of the present invention. Component box 100 may have a pedestal input connection/provision-for connection 170 and a corresponding aerial input connection/provision-for connection 172. Similarly, component box 100 may have a pedestal output connection/provision-for connection 174 and a corresponding aerial output connection/provision-for connection 176. A coaxial cable may be connected to connector 110 from pedestal orientation connection 170 or from aerial orientation connection 172. According to exemplary embodiments of the invention, changing between connection orientations 170 and 172 may be done by simply pulling the cable from one connection orientation and inserting it through the other connection orientation input without having to remove face plate 180 of splitter 100 and without having to loosen and tighten any screw, such as a seizer screw.

Similarly a coaxial cable may be connected to connector 120 in pedestal orientation connection 174 or in an aerial orientation connection 176. Again, changing between connection orientations 174 and 176 may be done without removing face plate 180 of splitter 160 and without having to loosen and tighten a seizer screw.

Figure 2A:
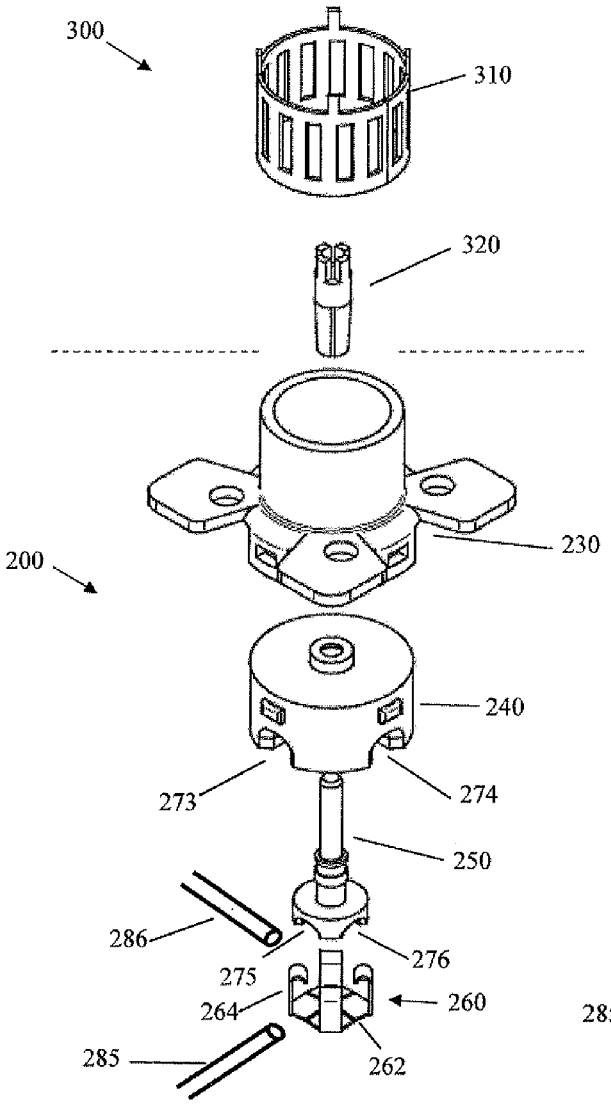
FIG. 2A is an exploded three-dimensional (3D) view of dual orientation connector assembly and a respective PCB connector according to embodiments of the present invention.
Figure 2C:
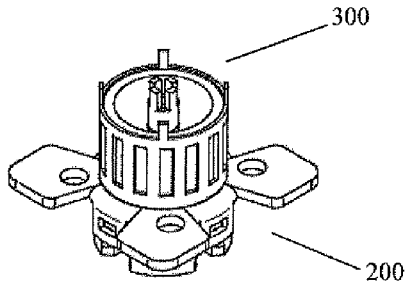
FIG. 2C is a 3D view of dual orientation connector assembly and a respective PCB connector assembled together in accordance to embodiments of the present invention.
Figure 2B:
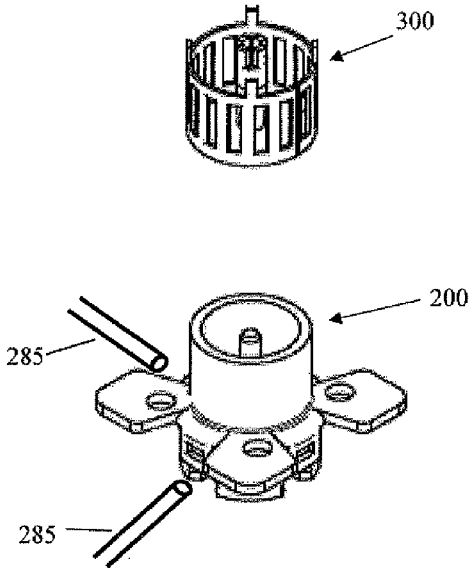
FIG. 2B is a 3D view of dual orientation connector assembly and a respective PCB connector assembly according to embodiments of the present invention.

Reference is now made to FIG. 2A which is an exploded 3D view of dual orientation connector assembly 200 and a respective PCB connector 300; FIG. 2B, which is a 3D view of dual orientation connector assembly 200 and a respective PCB connector 300 and FIG. 2C which is a 3D view of dual orientation connector assembly 200 and a respective PCB connector 300 assembled together in accordance to embodiments of the present invention.

Dual orientation connector assembly 200 may comprise a mechanical support element 230, an isolating element 240 encircling a portion of central conducting pin 250, and a conduction seizing spring element 260.

According to some embodiments of the invention, mechanical support element 230 may house the entire connector when assembled and may mechanically connect dual orientation connector assembly 200 to component box 100, for example by connecting it to a component card. Other suitable mechanical designs to support element 230 inside component box 100 may apply.

According to some embodiments of the invention, PCB connector 300 may comprise a conducting outer ring 310 and a central connection pin receptor 320. Conducting outer ring 310 may be an electrically conducting part connecting on one side to the outer conductor of a coaxial cable and to a PCB of the component box on the other side, thus electrically connecting the outer conductor of a coaxial cable to the PCB. Central connection pin receptor 320 may be adapted to receive one end of central conducting pin 250 of connector assembly 200 and connect it to a central pin of a respective connector on the PCB (not shown) with sufficient connection area ensuring good enough RF and AC power conduction.

Isolating element 240 may be shaped to contain most of the wider portion 254 of conducting pin 250 so as to electrically isolate it from adjacent conducting elements, but to allow firm connection of a central conductor 285, 286 of a coaxial CATV cable when inserted into connector assembly 200.

Figures 4A, 4B, 4C:
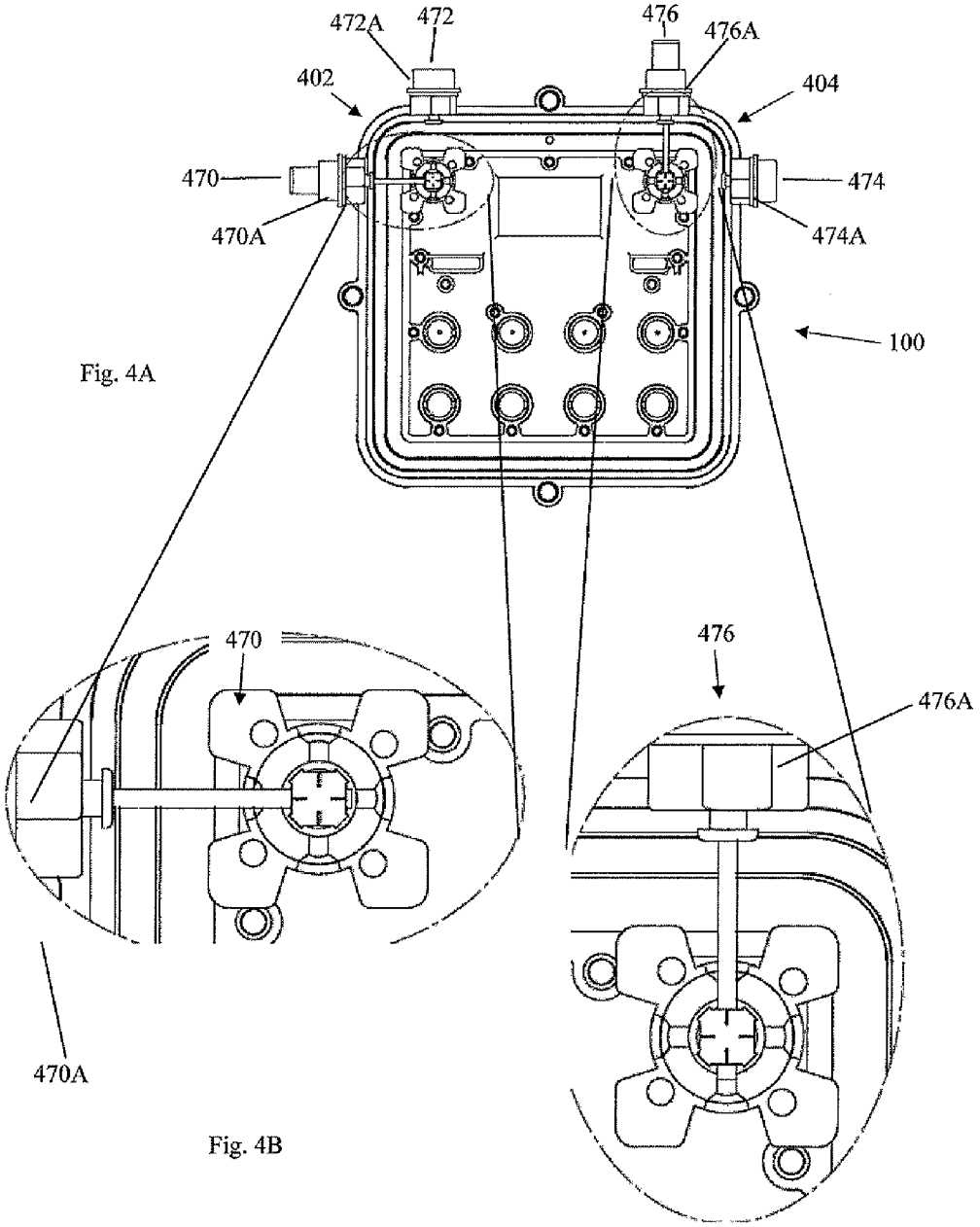
FIGS. 4A, 4B and 4C are a top view of component box and enlarged views of its pedestal/aerial connector zones, respectively, according to embodiments of the present invention.

Seizing spring element 260 may be adapted to encircle and hold a second end of central conducting pin 250 (lower end in FIG. 2A) when assembled so that when a central conductor of a coaxial cable, such as central cables 285, 286, is lead by and inserted through semi cylindrical recesses 273, 274 in isolating element 240 and further through semi cylindrical recesses 275, 276 of central conducting pin 250, the inserted end of cable 285, or 286 (one at a time) is pushed in between the central portion of seizing spring element 260 and is pressed tight by this portion against the lower end of central conducting pin 250, along recess 275 or 276, to provide high quality connection for the purpose of low-loss conduction of RF signals of up to 3 MHz and higher and/or AC power as high as 18 A or more in 240/115 Volts. The outer conductor of the coaxial cable is mechanically and electrically connected to an outer connection means of the connector assembly, such as 470A in FIG. 4B or 476A in FIG. 4C, in one of well known means and methods. As is depicted in FIG. 4A dual orientation connector zones 402 and 404 may comprise each a second orientation outer connecting means 472A and 474A, respectively.

Figure 2D:
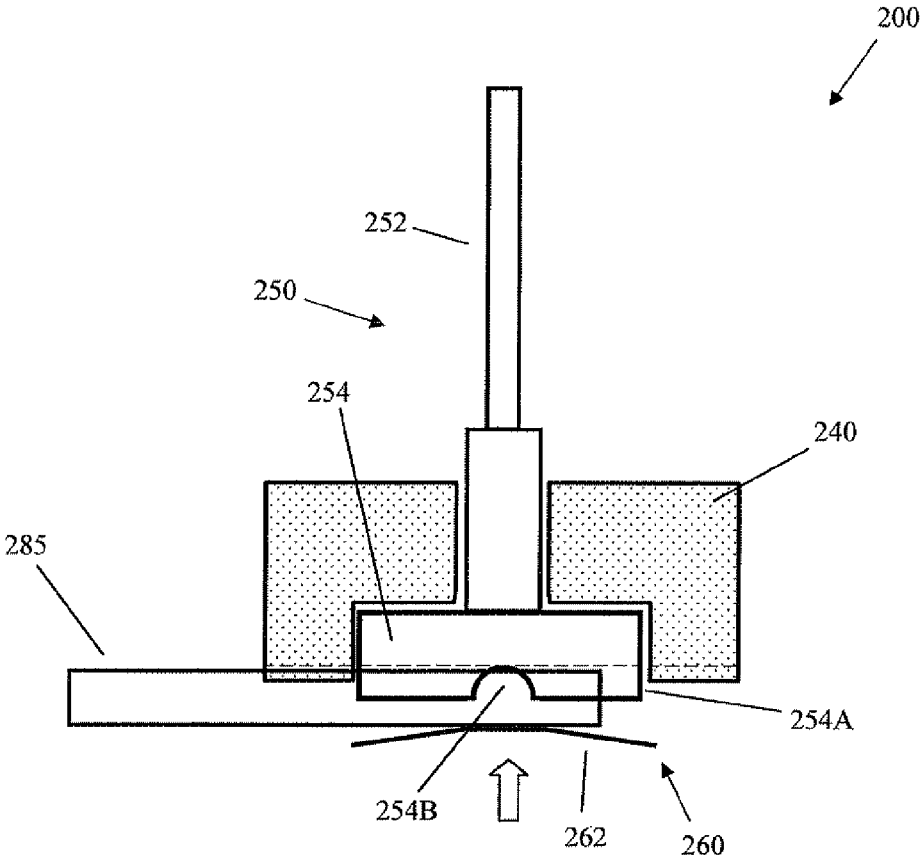
FIGS. 2D and 2E are a schematic partial side view illustration and a bottom view illustration, respectively, of a dual orientation connector according to embodiments of the present invention.
Figure 2E:
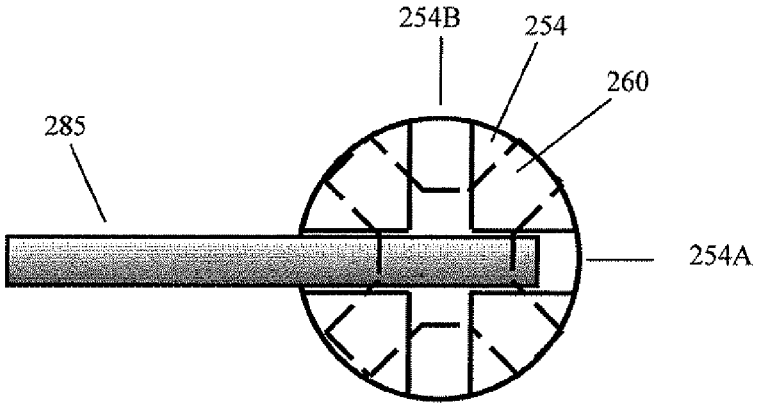

Reference is made now to FIGS. 2D and 2E, which are a schematic partial side view illustration and a bottom view illustration, respectively, of a dual orientation connector 200 according to embodiments of the present invention. The partial side and bottom views illustrations of dual orientation connector 200 in FIGS. 4D and 4E are shown with some of the elements drawn semi or fully transparent for clarity of explanation of the construction and operation of the device. Central conducting pin 250 may be shaped as a thin tubular pin 252 at one end (the upper end in FIG. 4D) and a wider cylindrical portion 254 at the other end (the lower end in FIG. 2D). End 254 of central conducting pin 250 may have a shape substantially of a small plane cylinder having two recesses 254A and 254B, made in its lower end, which is the end opposite to the end connected to pin 252. Recesses 254A and 254B which are made in end element 254 are elongated recesses stretching across the outer face of element 254 through its center from side-to-side in a right angle with respect to one another and spatially shaped as a semi-cylinders, shaped to accept a metal electrical conductor 285 having a cylindrical cross section, such as the central conductor of a coaxial cable, and to provide a high quality connection between the central conductor 285 and central conducting pin 250.

In order to ensure the quality of the connection between conductor 285 and central conducting pin 250 while allowing easy insertion or elicitation of conductor 285 into or out of dual orientation connector 200, a seizing spring element 260 is provided. Seizing spring element 260 has a central springy element 262 and several supporting legs 264 (shown in FIG. 2A). Legs 264, typically four of them, are provided at the perimeter of central element 262 and may provide leaning support from end element 254 of central conducting pin 250. When seizing spring element 260 is installed onto end element 254 of central conducting pin 250 central springy element 262 is placed so that its face is substantially parallel to the face of the lower end of end element 254 and the positions of legs 254 and the distance of central element 262 of seizing element 260 from the adjacent face of end element 254 enable smooth insertion or elicitation of central conductor 285 into, or from recess 254A or 254B, as may be required along with good electrical contact between central conductor 285 and central conducting pin 250 when central conductor 285 is inserted.

As is depicted in FIG. 2E, end element 254 of central conducting pin 250 has recessed in its lower end two recesses 254A and 254B, wherein their longitudinal dimension, along which a central cable of a coaxial cable may be inserted and placed, are in direct angle with respect to each other. Central springy element 262 of seizing element 260, shown in FIG. 2E in dashed line, may provide seizing pressure onto cable 285, while the size and position of its four wings, connected to supporting legs 264, allow free insertion or elicitation of cable 285 into or out of central conducting pin 250.

Figure 3A:
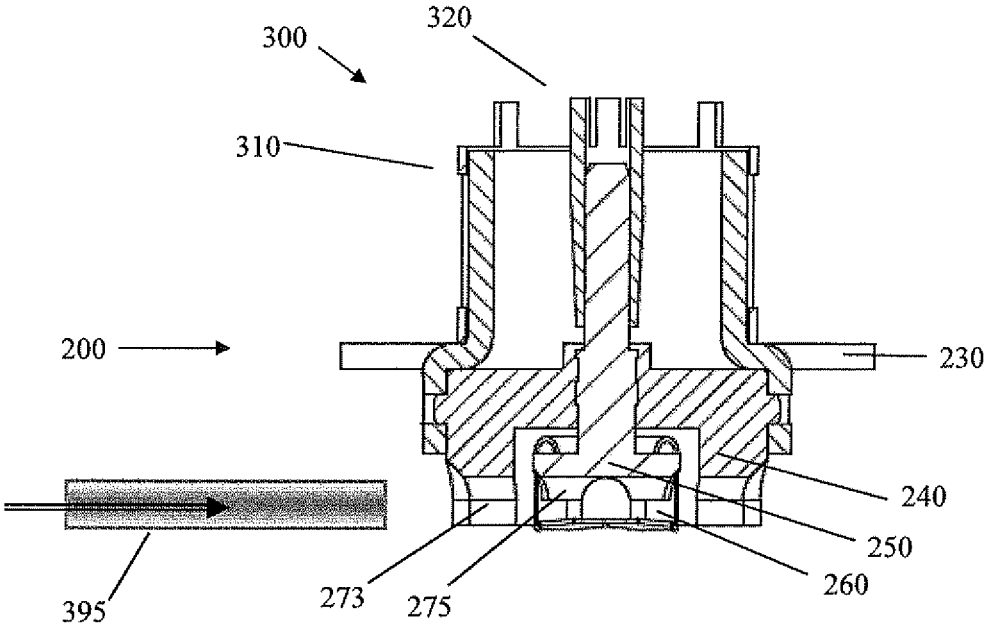
FIGS. 3A and 3B are schematic cross-sectional side view and top view, respectively, of dual orientation connector assembly in assembled view and of PCB connector connected onto the dual direction connector assembly, according to embodiments of the present invention.
Figure 3B:
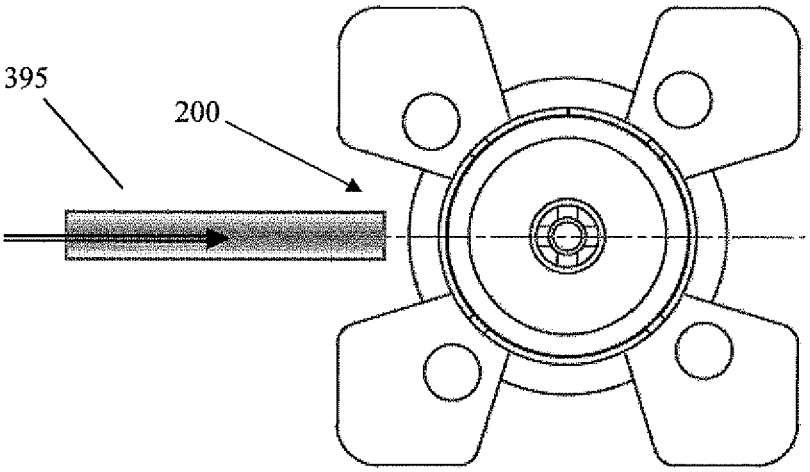

Reference is made now to FIGS. 3A and 3B, which are schematic cross-sectional side view and top view of dual orientation connector assembly 200 in an assembled view and where PCB connector 300 is connected onto dual orientation connector assembly 200, according to embodiments of the present invention. Support element 230, isolating element 240, central conducting pin 250, and conducting seizing spring element 260 are shown in the assembled view. Also shown are semi cylindrical recesses 273 and 275. Tip of central cable 395 of a coaxial cable is also shown to demonstrate the position of such central cable tip when it is about to be inserted into dual orientation connector assembly 200.

Reference is now made to FIGS. 4A, 4B and 4C, which are a top view of component box 100 with its face plate removed and enlarged views of its pedestal/aerial dual orientation connector zones 402 and 404, respectively. Connector zone 402 may comprise pedestal orientation type connections 470 and 474 and aerial orientation type connections 472 and 476. FIG.

4B depicts an enlarged view 402 of pedestal orientation type connection of connection 470 and FIG. 4C depicts an enlarged view 404 of aerial orientation type connection of connection 476. As is clearly depicted by the combined view of FIGS. 4A, 4B and 4C a pedestal orientation type connection, such as is depicted by connection 470, may be easily changed into an aerial orientation type connection, as depicted by connection 476, without requiring opening of component box 100 (its face plate is removed in FIG. 4A for clarity of the explanation), without needing to use a screwdriver and with ease of insertion of the central conductor 495, 496 into its location when making a connection, or ease of elicitation when canceling a connection.

Thus, as is clearly depicted in the drawings and described in the written description, a dual orientation connector assembly 200 according to embodiments of the present invention may overcome drawbacks of connectors of the prior art and provide the following advantages:

- having operational bandwidth of about 0 to 3000 MHz, where known connectors support only a range of 0 to 1000 MHz;
- providing lower loss and flatter response curve compared to known connectors, over the operational bandwidth of 0 to 3000 MHz;
- enabling to pass thru the main line AC current of about 15 A, while providing low AC power drop;
- eliminating the need to remove the passive device face plate (required usually in the known devices in order to select internally the PEDESTAL or AERIAL port). With the new connector this selection may done with closed, un-removed face plate;
- eliminating the need to have the seizer screw mechanism as in known devices;
- eliminating the need to use a screwdriver for tightening the seizer screw as in known devices;
- allowing the device the current invention to be installed in smaller space since and no access is required for a screwdriver as is the case with known devices;
- saving technician time when installing, as compared with the time required with the seizer screw arrangement of the known deices;

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. A dual orientation connector assembly comprising:

a central conducting pin having a first portion shaped as a thin tubular pin at a first end and a second portion shaped as a wider cylindrical portion at the second end;

a seizing spring element having at least a central element and several supporting legs; and at least one isolating element encircling a portion of said wider portion of said central conducting pin, wherein said wider portion of said central conducting pin has engraved on an outer face of said wider portion two elongated recesses stretching across the outer face through a center of said wider portion, from side-to-side in a right angle with respect to one another, wherein said seizing spring element is shaped to provide substantial pressure to a central conductor when said wider portion is received in the seizing spring element and said central conductor is inserted along one of said recesses.

2. The connector of claim 1, further comprising a first outer connection means associated with a first connection orientation and a second outer connection means associated with a second connection orientation.

3. The connector of claim 1 further comprising an isolating element encircling a portion of said central conducting pin.

4. The connector of claim 1, wherein said central conducting pin is screw-less.

5. The connector of claim 1, wherein said wider portion is cylindrical.

6. The connector of claim 1, wherein said elongated recesses are semi-cylindrical.

* * * * *